United States Patent [19]

Druet

[11] Patent Number: 4,501,609

[45] Date of Patent: Feb. 26, 1985

[54] METHOD AND APPARATUS FOR THE SINTERING OF A MINERAL USING GASEOUS FUEL

[75] Inventor: Jean-Pierre Druet, Thionville, France

[73] Assignee: Société Lorraine de Laminage Continu SOLLAC, Florence, France

[21] Appl. No.: 573,474

[22] Filed: Jan. 24, 1984

[30] Foreign Application Priority Data

Jan. 27, 1983 [FR] France ..... 83 01251

[51] Int. Cl.[3] ..... C22B 1/16

[52] U.S. Cl. ..... 75/5; 75/3; 266/158; 266/178

[58] Field of Search ..... 75/3-5; 266/158, 178

[56] References Cited

U.S. PATENT DOCUMENTS 4,067,727 1/1978 Cappel ..... 75/5

4,194,729 3/1980 Wacker ..... 75/5

*Primary Examiner*—Peter D. Rosenberg

*Attorney, Agent, or Firm*—Laubscher, Philpitt & Laubscher

[57] ABSTRACT

A method and apparatus are disclosed for the sintering of an ore using gaseous fuel. A layer of noncombustible particulate mineral material is arranged on a supporting grate, and hot fumes derived from gaseous fuel are passed downwardly through the layer of material. The temperature of the hot fumes is sufficient to initiate fusion or sintering of the mineral material. Predrying, sintering and cooling means are provided along the length of the supporting grate in order to effect the desired sintering.

3 Claims, 1 Drawing Figure

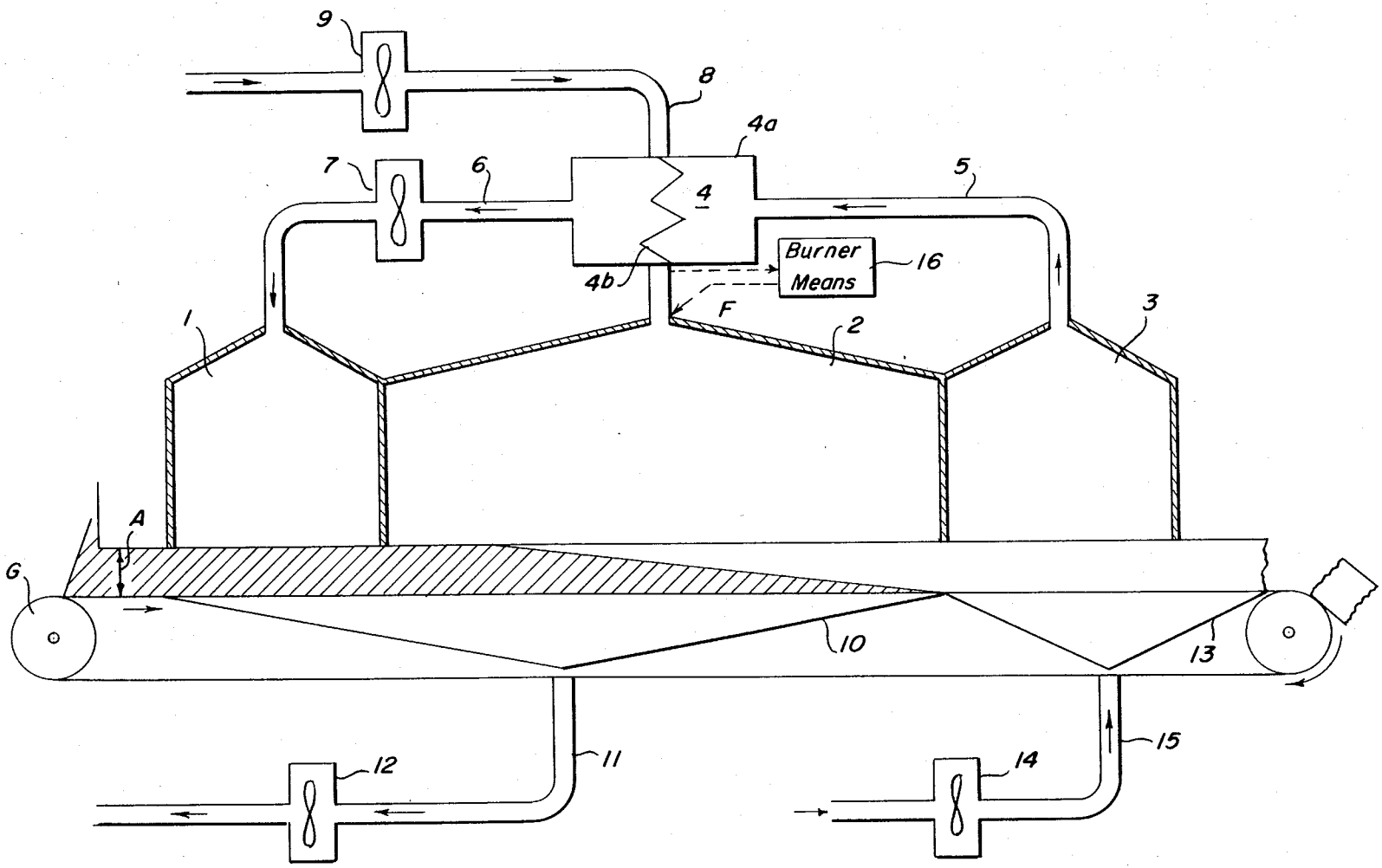
Burner Means
1
2
3
4
4a
4b
5
6
7
8
9
10
11
12
13
14
15
16
A
F
G

METHOD AND APPARATUS FOR THE SINTERING OF A MINERAL USING GASEOUS FUEL

FIELD OF THE INVENTION

The present invention relates to a method for the agglomeration or sintering of an ore, particularly iron ore, using a gaseous fuel with occasionally addition of a solid fuel. The method may be of particular use in steel mills which make iron ore sinter and which have large quantities of gas available, even gas having little heating power.

In the case of steel mills that do not include an electric power plant, a large portion of gas is lost when it is burned off in the excess gas burner. The method according to the invention is directed at consuming a maximum of gaseous fuel for the manufacture of sinter. The present method may also be used in other industries whenever it is necessary to produce sinter and whenever fuel gas is available at a worthwhile economic cost.

BACKGROUND OF THE INVENTION

Sintering processes which are presently known and in use are of the following general type. An ore which is to be sintered is mixed with a solid fuel such as coal, return fines and an appropriate amount of water. The resultant mixture is pelletized or nodulized and placed on a conveyor belt. The height of the deposited layer may generally vary between approximately 30 and 70 centimeters. The mixture is delivered to an ignition hood equipped with burners which furnish hot fumes at the temperature necessary for the fusion of the ores. The mixture is ignited by means of the combustible solid fuel which is included therein. When an iron ore similar to that found in the geographic area of Lorraine, France, is to be sintered, the heat supply required for satisfactory sintering is on the order of 50 thermies per ton (th/t) of sinter (a thermie being an international unit approximately equal to 4 million B.T.U.'s). After the mixture is ignited, cold air is passed downwardly therethrough until the combustion front reaches the conveyor bars. The resultant sinter is then cooled either on a conveyor belt by means of cold air passing downwardly as in the agglomeration phase, or by means of an outside cooler after having been partly crushed and possibly screened.

There are variations to this generally described process. A portion of the solid fuel may be replaced with heat supplied in the gaseous form by hot fumes produced in a hood situated immediately after the ignition hood. The temperature of these fumes can be varied along the length of this second hood and their oxygen content must be sufficient in order to suitably burn the solid fuel of the mixture. However, even when an optimization of the temperature and the oxygen content of the hot fumes is achieved, the heat contribution of hot fumes cannot exceed 10% of the total heat contribution to the process without a major decline in the heat balance. Another variant involves predrying the mineral charge prior to ignition. However, this may be done only at a low temperature of less than 350° C. or by using neutral fumes in order to prevent the solid fuel from catching fire. The aforementioned processes however entail the following disadvantages.

(a) a large heat loss occurs due to unburned fuel material in the fumes (CO, volatile substances); this represents a minimum of 15% of the heat contributions of the solid fuel, for example, 60 th/t of Lorraine ore sinter;

(b) a noticeable heat loss occurs in the sinter (from 60 to 100 th/t), a portion of which, to be sure, can be recovered in the cooling process, but which yields heat at a low level (300° C. maximum);

(c) the resultant agglomerate reduction capability is far from the optimum because the use of solid fuel locally raises the sinter to a temperature which is definitely higher than the ore fusion point (1220°–1230° C., for example, for an iron ore from Lorraine) which leads to a loss of porsity of the material; and (d) a major expulsion of the polluting gases of the NOx and SOx type occurs from the use of coal, together with the associated problems of corrosion.

SUMMARY OF THE INVENTION

Accordingly, it is an object of the present invention to overcome the aforementioned and other disadvantages of the prior art by providing a method and apparatus for the sintering of ore which completely eliminates the use of or substantially reduces the amount of solid fuel previously mixed with the ore. More particularly, the present invention relates to a method and apparatus for the sintering of an ore using gaseous fuel. A layer of said ore with noncombustible constituent elements for sintering is arranged on a supporting grate, and hot fumes derived from gaseous fuel are passed downwardly through the layer of material thereby to form a sinter. The temperature of the hot fumes is sufficient to initiate fusion or sintering of the ore. Predrying, sintering and cooling means are provided along the length of the supporting grate in order to effect the desired sintering.

Thus, for example, for iron ore from Lorraine, France, hot fumes at a temperature of 1300° C. are passed downwardly through the layer of the mixture in order to bring the latter to a temperature of 1250° C., which is the fusion temperature for such ore from Lorraine.

Aspirating these gases at such a high temperature through a layer of ore to initiate fusion according to the method of the present invention may appear to be rather delicate and perhaps even illusory operation in view of the apparent lack of permeability of the ore. It would appear that the process would undoubtedly lead to very low productivities. However, it has been discovered that, while the charge loss increases in the beginning of the process, as the temperature of the hot fumes aspirated through the layer increases, an abrupt rise in permeability occurs when the fusion temperature of the material is reached. This is due to the fact that, once melted, the material coalesces, leading to the formation of pores through which the hot gases can easily circulate, thereby rendering an increased productivity.

The process makes it possible to operate if necessary at layer heights of 20 or even 10 centimeters to adapt the productivity.

The method of the invention preferably includes the following additional steps. The sinter is cooled by a cooling gas blown upwardly, which gas, thus heated, is used to produce hot air intended for use in the sintering process and is further used to predry the ore prior to sintering. Moreover, the cooling of the sinter is preferably accomplished until the upper layer of the sinter has a temperature of about 250° C.

The apparatus of the invention is characterized in that it comprises a sintering grate completely covered by, successively, a first hood to distribute the hot predrying gases, a second sintering hood equipped with burners, and a third cooling hood to catch the hot gases from the cooling air that is passed through the sintered cake. The apparatus further includes a heat exchanger which receives the hot gases recycled from the cooling hood and fresh cold air. A portion of the heat from the hot gases is transferred to the fresh air which is then directed to the burners contained in the sintering hood. The partially cooled gases are then directed to the predrying hood.

BRIEF DESCRIPTION OF THE DRAWING

Other objects and advantages of the present invention will become apparent from the following detailed description when viewed in light of FIG. 1 which discloses a schematic view of the apparatus of the present invention.

DETAILED DESCRIPTION

Referring to FIG. 1, the apparatus of the present invention first includes a sintering grate means G for supporting a layer of the particulate nodulized noncombustible ore A thereon. The grate means G moves in a linear path and preferably comprises a perforated endless rotating conveyor belt. In one embodiment the belt may comprise a suitable chainlike material.

The agglomeration grate G is completely covered by an enclosure which comprises a predrying means, a sintering means and a cooling means. The predrying means includes a predrying hood 1 arranged above the linear path of movement of the agglomerating grate G. The hood 1 directs hot predrying gases to the mineral material layer supported on the agglomerating grate.

The sintering means is arranged downstream of the predrying hood 1 above the linear path of movement of the grate G. In the sintering means, the layer of mineral material is heated by hot fumes to a temperature sufficient to effect fusion thereof. The sintering means includes a sintering hood 2 and means including a conduit 8 for supplying fresh air to the sintering hood 2. Associated with the sintering means is a plurality of burners, shown in the drawing only schematically as burner means 16. The burner means 16 may be of any type commonly known in the art and may even be a component of a blast furnace. The burner means provides the hot fumes which are derived from gaseous fuels supplied thereto.

The cooling means of the apparatus of the invention includes a cooling hood 3 arranged downstream of the sintering hood 2 above the linear path of movement of the grate G. The cooling hood recovers the gases used to cool the sintered product.

A heat exchanger 4 is provided which includes two fluid paths, 4*a* and 4*b*, therethrough. The function of the heat exchanger 4 in the method of the invention will become apparent when discussed more fully below.

A conduit 5 leads from the cooling hood 3 to the heat exchanger 4 and delivers the gases heated during the cooling process to the fluid path 4*a* in the exchanger. A conduit 6, provided with a fan 7, delivers these gases which have gone through path 4*a* of the exchanger to the predrying hood 1. A conduit 8 is provided with a fan 9 for supplying fresh cold air to the fluid path 4*b* of the exchanger. Fluid paths 4*a* and 4*b* are in heat exchange relation to one another so that a portion of heat from the hot gases in path 4*a* is transferred to the relatively cold air in path 4*b*.

The relatively warm fresh air in path 4*b* is then directed to the burners in the sintering means. This is disclosed in FIG. 1 by means of the phantom line leading to the burner means 16. Thus, the burner means 16 supplies hot fumes to the sintering hood 2, disclosed schematically by the phantom line which enters the top of the sintering hood at the point designated by the letter F. The hot fumes are derived from a gaseous fuel comprising hot air and, for example, blast furnace gas.

Underlying the sintering grate G are two enclosures 10 and 13, the converging enclosure 10 being arranged under the predrying hood 1 and the sintering hood 2, and the diverging enclosure 13 being arranged under the cooling hood 3. A conduit 11 provided with a fan 12 communicates with the enclosure 10 for directing the predrying gases and sintering fumes from their respective zones to an exit. In another embodiment, two of the fans 12 may be provided for assigning one fan to the predrying zone and one fan to the sintering zone. A conduit 15 provided with a fan 14 communicates with the enclosure 13 for introducing fresh cooling air upwardly through the sinter on the grate G.

The apparatus thus described may be used in the method of the present invention as follows. The mixture with ore which is to be sintered is nodulized or pelletized in the usual manner except that the solid fuel constituent normally used is excluded. The nodulized ore is arranged in a layer of desired thickness on the grate G.

The endless conveyor belt grate G first moves the mineral material through the predrying hood 1 where the hot gas passes downwardly therethrough. The grate then moves the material through the sintering hood 2 where the hot fumes derived from gaseous fuel at the burner means 16 passes downwardly through the material layer. The hot fumes are at a temperature of about 1300° C.

The sintering operation is continued until the heat front reaches the grate G. The progression of the heat front is shown in FIG. 1 by the progressive disappearance of the hatch lines. In certain instances, the heat front corresponds to a temperature of the fumes under the grate of from 400° to 450° C., similar to that which occurs during conventional sintering at maximum fume temperature.

The moment the temperature of from 400° to 450° C. is reached, cooling of the agglomerate begins. A cooling gas is passed upwardly therethrough. The main reason for this method of cooling is to prevent the bars of the grate from reaching an excessively high temperature. The cooling continues until the sinter of the upper layer is at 250° C. The sinter is then removed from the enclosure and screened cold before it is transferred to the blast furnace.

Depending on local conditions, the mill or plant may not have enough fuel gas to produce all of its sinter without further heat supplied. In this case, there is a variation of the method of the present invention which consists in providing a small portion of the heat supply in the form of solid fuel.

If a portion of the heat supply is furnished in the form of solid fuel, the fumes developing in the sintering hood should contain a sufficient quantity of oxygen to burn the fuel. Furthermore, the heat supply from gaseous fuel must be diminished at the rate of heat supply added in the form of solid fuel. Assuming a specific volume of gas is necessary for heat transfers in the layer, the volume of fumes developed in the sintering hood must remain constant. It is thus the specific enthalpy of the fumes or essentially their temperatures which must be diminished at the same rate at which heat is added in the form of solid fuel.

It should be noted that optimization of the process of the invention must be made on an individual basis. One must in particular take into account the quantity of gas available, the the quantity of fuel to be added, the temperature of the air intended for the agglomeration hood at the output of the exchanger, the oxygen rate in the fumes which results therefrom as well as the combustion yield of the solid fuel, if included. The thickness of the material layer to be agglomerated is also a parameter. The layer thickness influences the average temperature of the cooling gas at the input of the exchanger and the temperature of the combustion air entering the sintering hood. This is particularly true if the fumes which are produced are at a temperature lower than the fusion temperature of the mixture. The height of the layer furthermore effects the characteristics of the sinter produced by virtue of the time it is kept at a high temperature.

An economic advantage of the invention resides in the appropriate recovery of the heat from the sinter, the amount of which is about the same as the amount of heat required for operating the process. The heat is recovered with the help of the cooling gas having high thermal level. Preferably, the gas is then partly cooled in an exchanger having a poor yield (about 50%), i.e. having moderate exchange surfaces and a moderate price, in order to heat the fresh air to a temperature level permitting the use of gas with a low calorific power for the production of the sinter. The gas thus partly cooled is then used for the partial predrying of the mixture, thus in general terms leading to an effective recovery of 75% of the heat of the sinter. Thus, the over all heat consumption of the present method is less than that of the conventional processes.

While the preferred forms and embodiments of the invention have been illustrated and described, it will be apparent that modifications may be made without departing from the scope of the invention set forth above.

What is claimed is:

1. Method for the sintering of a noncombustible ore, comprising the steps of (a) arranging a layer of said ore and other noncombustible consituent elements for sintering on a supporting grate; and (b) passing hot fumes produced from the combustion of gaseous fuel downwardly through said layer, the temperature of said hot fumes being sufficient to initiate fusion of said ore thereby to form a sinter.

2. Method as defined in claim 1, wherein said sinter is cooled to a temperature of about 250° C.

3. Method for the sintering of a noncombustible ore, comprising the steps of (a) arranging a layer of said ore and other noncombustible constituent elements for sintering on a supporting grate;

(b) passing hot fumes derived from gaseous fuel downwardly through said layer, the temperature of said hot fumes being sufficient to initiate fusion of said ore thereby to form a sinter;

(c) cooling said sinter by passing a cooling gas upwardly therethrough, which cooling gas is thus heated by said sinter; and (d) recycling said heated cooling gas initially in heat exchange relation with an air stream adapted for use in forming said hot fumes, and subsequently through said mineral material prior to its sintering to effect drying of said mineral material.

* * * * *